US006237866B1

(12) United States Patent
Nagayama

(10) Patent No.: US 6,237,866 B1
(45) Date of Patent: May 29, 2001

(54) YARN UNWINDING TENSION STABILIZER AND A YARN UNWINDING TENSION STABILIZING APPARATUS FOR A WARPING CREEL USING THE SAME

(75) Inventor: Yoshiyuki Nagayama, Fukui (JP)

(73) Assignee: Yagikuma & Co., Ltd., Fukui (JP)

( * ) Notice: Subject to any disclaimer, the term of this patent is extended or adjusted under 35 U.S.C. 154(b) by 0 days.

(21) Appl. No.: 09/341,432

(22) PCT Filed: Feb. 10, 1999

(86) PCT No.: PCT/JP99/00563

§ 371 Date: Jul. 9, 1999

§ 102(e) Date: Jul. 9, 1999

(87) PCT Pub. No.: WO99/41182

PCT Pub. Date: Aug. 19, 1999

(30) Foreign Application Priority Data

Feb. 17, 1998 (JP) ..... 10-034948

(51) Int. Cl.[7] ..... B65H 49/00

(52) U.S. Cl. ..... 242/129.8; 242/131.1; 242/147 R; 242/156.1; 242/566; 242/615.3

(58) Field of Search ..... 242/129.8, 131, 242/131.1, 147 R, 156.1, 128, 594.5, 594.6, 566, 615.3; 139/450

(56) References Cited

U.S. PATENT DOCUMENTS 948,945 * 2/1910 Smith .
2,366,101 * 12/1944 Grothey .
2,838,922 * 6/1958 Gift .
2,953,318 * 9/1960 Hasler et al. .
2,965,330 * 12/1960 Hoekstra .
3,461,691 * 8/1969 Ballard ..... 242/131
3,632,062 * 1/1972 Sole ..... 242/131 X
4,699,331 * 10/1987 Zorini ..... 242/131

FOREIGN PATENT DOCUMENTS

593200 * 11/1977 (CH) .
623086 * 5/1981 (CH) .
2841210 * 4/1979 (DE) .
534896 * 3/1993 (EP) .
56-33353 * 3/1981 (JP) .

* cited by examiner

*Primary Examiner*—Donald P. Walsh
*Assistant Examiner*—Minh-Chau Pham
(74) *Attorney, Agent, or Firm*—Snider & Associates; Ronald R. Snider

(57) ABSTRACT

A yarn unwinding tension stabilizer capable of stably unwinding a yarn from various types of yarn suppliers in such shapes as cheese and cone so as to effectively cope with such drawbacks as slide of wound layers on a yarn supplier and slippage of yarn loops therefrom due to the ballooning of an unwound yarn and so forth and a yarn unwinding tension stabilizing apparatus for a warping creel capable of simultaneously setting said stabilizers on the multiple number of the suppliers suspended on the warping creel in an easy operation. The tension stabilizer (3) is arranged by disposing the plurality of elastic wiring materials (2) on the opening (10) of the supporting member (1) in such a manner that said materials convavely curve towards the center of said opening and overlap one another. The frame, in which the plurality of said stabilizers are aligned in rows, is arranged such that it is horizontally movable as a whole.

18 Claims, 8 Drawing Sheets

YARN UNWINDING TENSION STABILIZER AND A YARN UNWINDING TENSION STABILIZING APPARATUS FOR A WARPING CREEL USING THE SAME

RELATED APPLICATION

The present application claims the priority of the Japanese Patent Application No.10-34948 filed on Feb. 17, 1998.

BACKGROUND OF THE INVENTION

1. Technical Field

The present invention relates to a yarn unwinding tension stabilizer and a yarn unwinding tension stabilizing apparatus for a warping creel using this stabilizer, in more detail, relating to such stabilizer that can stably unwind a yarn from various types of yarn suppliers in such shapes as cheese and cone by effectively coping with such drawbacks as slide of wound layers on a yarn supplier and slippage of yarn loops therefrom due to the ballooning of an unwound yarn and so forth as well as such apparatus that facilitates to simultaneously adapt those stabilizers on a multiple number of yarn suppliers suspended on a warping creel.

2. Prior Art

As well known, when a multiple number of yarns are treated by a warper or warping sizer, the yarns are simultaneously unwound from the respective yarn suppliers in such shapes as cheese and cone which are suspended on a warping creel. In this process, if the unwinding speed is overdone, it is known that there occur slide of wound layers on a yarn supplier and slippage of yarn loops therefrom due to the ballooning of an unwound yarn and so forth so as to cause large fluctuation of the unwinding tension on the yarn, with the result that there occurs yarn cut during the operation, and especially a hard twist or finished yarn becomes very susceptible to kinky texture.

To restrain the ballooning of the unwound yarns and deal with such drawbacks, such arrangement is conventionally known that the respective suppliers suspended on a warping creel are covered with a cylindrical sheet with an appropriate weight attached thereto, which contacts the unwound yarns.

The inconvenience in this prior method to stabilize a yarn unwinding tension is that as the diameter of the supplier becomes smaller as the unwinding operation proceeds, the degree of contact between an unwound yarn and the cylindrical sheet becomes smaller, with the result that optimum tension stabilization can not be obtained consistently throughout the operation. Also, it takes a lot of time and labor to cover the respective suppliers, which it is common are suspended on the creel with more than 1000 pieces at a time, with a cylindrical sheet and to attach a weight thereto.

DISCLOSURE OF THE INVENTION

In view of the above-mentioned inconvenience in the prior method to stabilize a yarn unwinding tension by means of said sheet, the present invention is to provide a yarn unwinding tension stabilizer capable of stably unwinding yarn from various types of suppliers in such shapes as cheese and cone without causing any slide of wound layers on the suppliers or slippage of yarn loops therefrom due to the ballooning of unwound yarns and the like.

The present invention is also to provide a yarn unwinding tension stabilizing apparatus for a warping creel wherein the above-mentioned stabilizers can be set on a multiple number of yarn suppliers suspended on the creel at one time in an easy operation.

As a means to realize the above tension stabilizer, the present invention has adopted an arrangement comprising a supporting member (1) provided with an opening (10) of a diameter and a plurality of elastic wiring materials (2) disposed within said opening (10), the respective wiring materials (2) being fixed at both ends thereof on the periphery of said opening (10) and convexly curving towards a center of said opening (10) while partly overlapping one another, an unwinding area (20) being formed at said center, which is enclosed with those overlapped wiring materials (2), wherein tension acting on a yarn (Y) unwound from a yarn supplier (B) and threaded into said area (20) is stabilized by making said wiring materials (2) in contact with the surface of the yarn wound on said supplier (B).

Also, as a means to realize the above tension stabilizing apparatus for a warping creel, the present invention has adopted a mechanism, which is disposed as opposed to a plurality of pegs (P) aligned in rows in the creel and stabilizes tension acting on a yarn (Y) unwound from the respective yarn suppliers (B) suspended on said pegs (P), said stabilizing apparatus comprising a plurality of tension stabilizers (3) respectively made of a supporting member (1) provided with an opening (10) of a diameter and a plurality of elastic wiring materials (2) disposed within said opening (10) wherein the respective wiring materials (2) are fixed at both ends thereof on the periphery of said opening (10) and convexly curve towards a center of said opening (10) while partly overlapping one another and an unwinding area (20) is formed at said center, which is enclosed with those overlapped wiring materials (2); a frame (5) supporting those tension stabilizers (3) in alignment with the suppliers (B) suspended on said pegs (P); and a means (6) to horizontally move said frame (5) so as to make said tension stabilizers (3) simultaneously approach to and retract from said suppliers (B).

BEST MODE FOR CARRYING OUT THE INVENTION

Hereinafter, the present invention is described in more detail with reference to the accompanying drawings.

Figure 1:
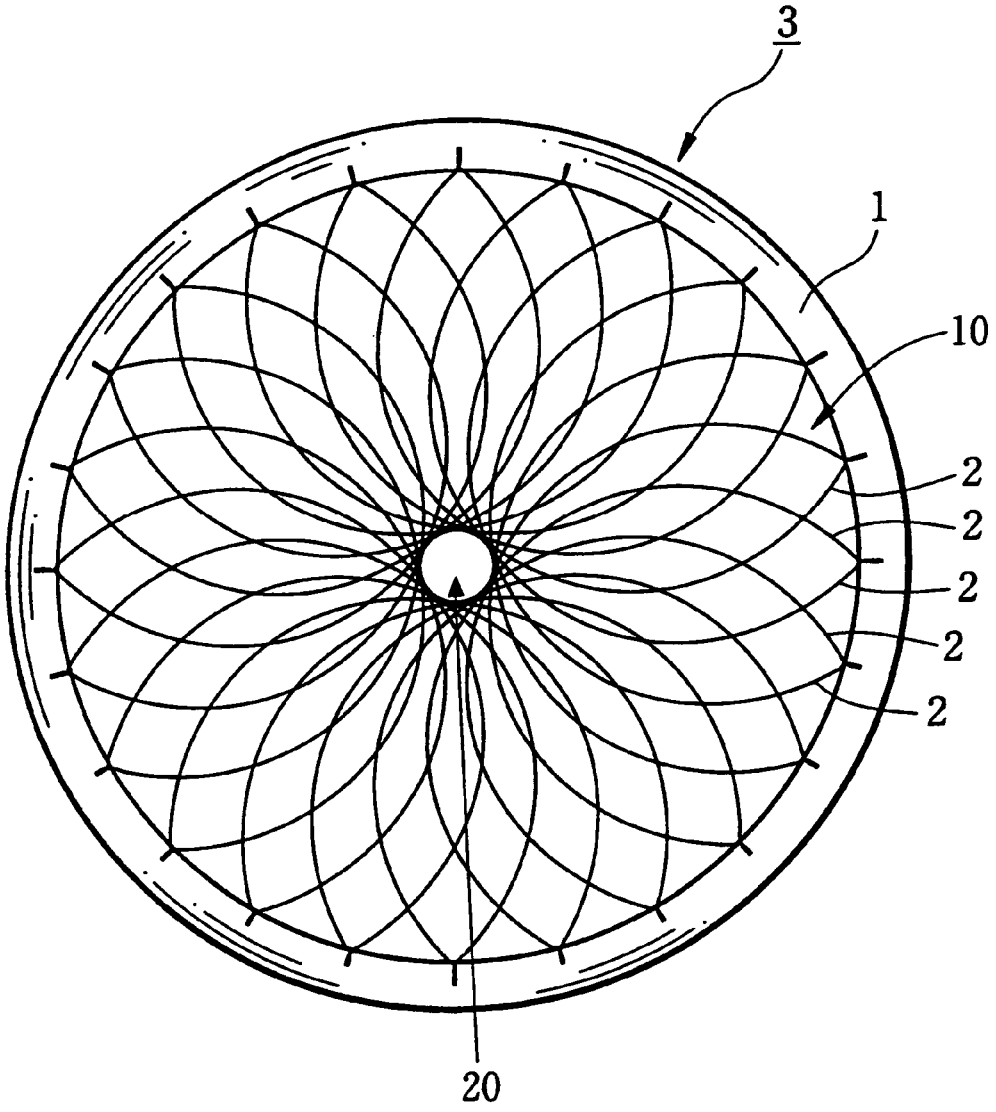
FIG. 1 is the whole frontal view of a yarn unwinding tension stabilizer embodied in the present invention.

In the frist place, with reference to FIGS. 1 and 2, a yarn unwinding tension stabilizer (3) is described as follows. This stabilizer comprises a supporting member (1) provided with an opening (10) therein and a plurality of wiring materials (2) disposed within said opening. The member (1) is formed in a ring shape by cutting a vinyl chloride resin pipe by 10 mm in thickness, whose outer diameter is 318 mm and inner diameter is 288 mm, while a nylon resin monofilament (No. 8 fishing gut) whose diameter is about 0.5 mm is used for the wiring material (2).

The arrangement of said stabilizer (3) is such that a unwinding area (20) with about 30 mm in diameter is formed in the center of said opening (10) by enclosing this area with a plurality of wiring materials, the respective wiring materials being fixed at both ends thereof at a different place on the periphery of the opening (10) with concavely curving towards the center of the opening and partly overlapping or intersecting one another.

Figure 2:
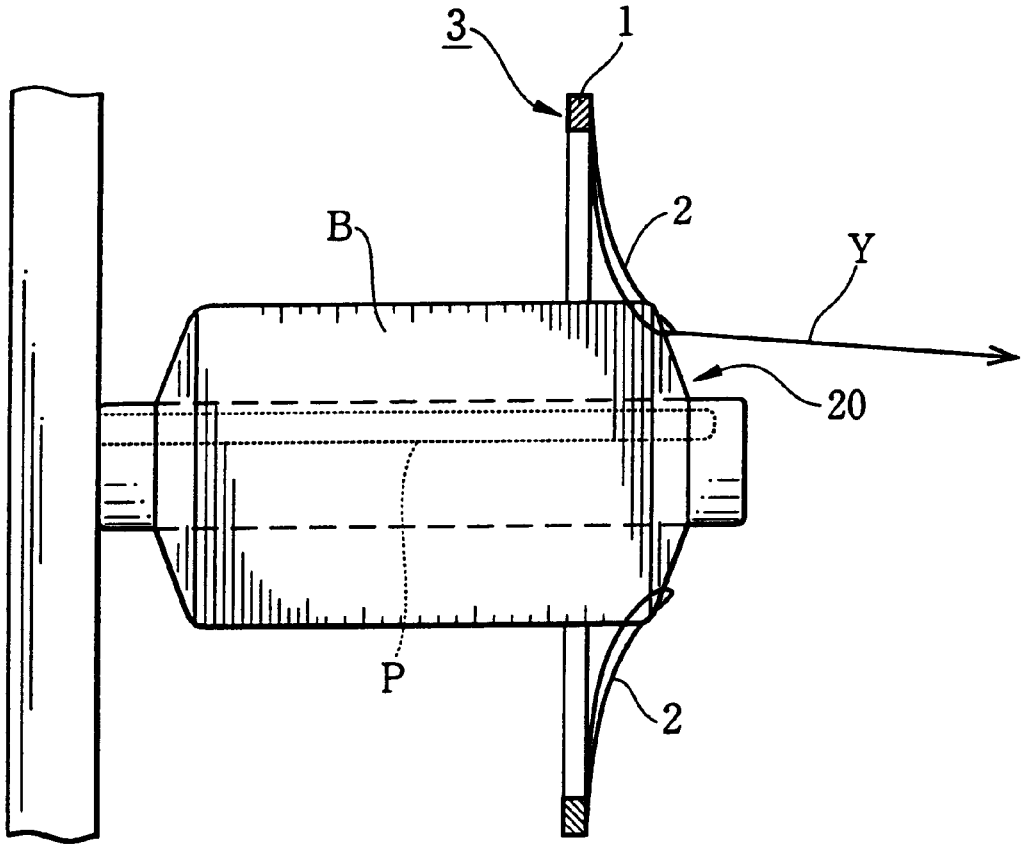
FIG. 2 is a cross sectional view of said stabilizer showing the state where it is set on a yarn supplier.

As shown in FIG. 2, by threading a yarn (Y) unwound from the supplier (B) into the unwinding area (20) of the stabilizer (3) as described above and making said stabilizer in contact with the yarn surface of the supplier (B) while bending the respective wiring materials thereof in elastic deformation, a yarn (Y) unwound from the supplier (B) is interposed or elastically compressed between the wiring materials (2) and the yarn surface of the supplier. In this way, the contact of the wiring materials and the yarn surface of the supplier with the unwound yarn (Y) stabilizes tension acting on the latter. What is indicated with a reference (P) in FIG. 2 is a multiple number of pegs protrusively provided on a warping creel to suspend the yarn suppliers (B).

With the tension stabilizer (3) embodied in the present invention, as the respective wiring materials (2) are fixed at both ends thereof on the supporting member (1) as well as overlap or intersect one another, the collective bending elasticity (rigidity) of the respective wiring materials, which is optimum for tension stabilization, can be easily obtained while the permanent set of the respective wiring materials can be restrained, so that it becomes possible to keep tension acting on the yarn stable for a long period of time.

With the tension stabilizer (3) embodied in the present invention, as the unwinding area (20) is formed in such a manner that it is enclosed with the respective wiring materials (2) whose both ends are fixed on the supporting member and which curve towards the center of the opening (10), a yarn (Y) unwound from the supplier (B) while rotating along the wound yarn surface thereof contacts the respective wiring materials (2) in a smooth and stable manner. Therefore, it becomes possible to perform an extremely stable and secure unwinding operation without causing torsion on the wiring materials (2).

With the tension stabilizer (3) embodied in the present invention, as it takes advantage of the collective bending elasticity of the plurality of the wiring materials which overlap and intersect one another, there hardly occurs fluctuation of tension stabilizing performance due to the change in diameter of the supplier, so that it becomes possible to secure a stable yarn unwinding tension to the end of the operation.

The tension stabilizer of the present invention is arranged as mentioned above, but it is not limited to this embodiment. It should be understood that it can be modified in various manners within the scope of the accompanying claims.

Figure 3:
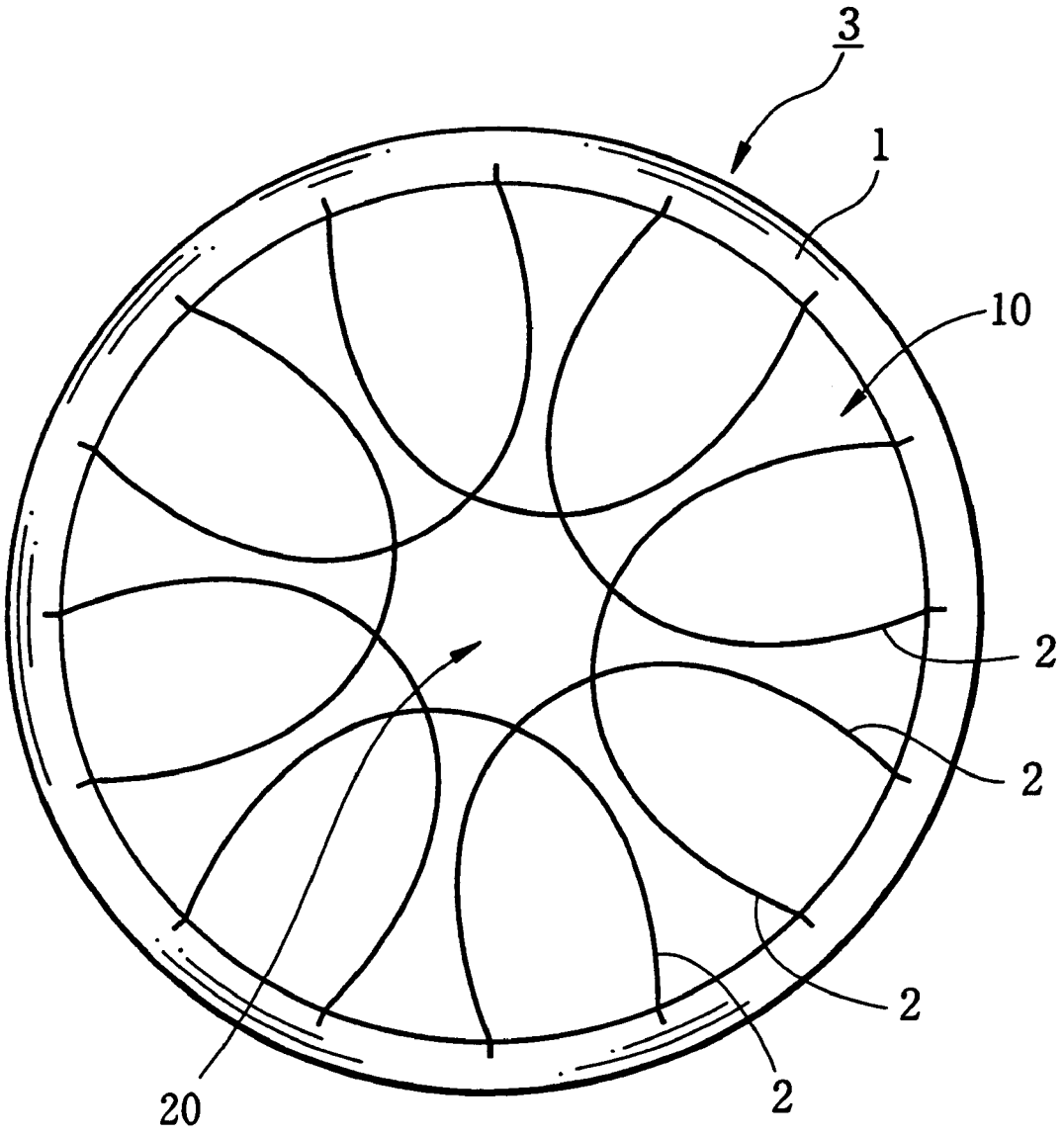
FIG. 3 is the whole frontal view of the stabilizer showing one of its modifications.

For example, in the above-mentioned embodiment, when the wiring materials are fixed at both ends thereof on the periphery of the supporting member (1), any one of them interposes four fix points between its both ends, at the respective points two wiring materials being fixed at one end thereof, but it is not limited to this arrangement. It does not matter whether both ends are adjacently fixed to each other or it interposes two fix points therebetween, at the respective points one wiring material being fixed at one end thereof, as shown in FIG. 3. It can be modified in various manners in view of the type, diameter of the supplier (B), a yarn unwinding speed and so on. If it interposes more fix points therebetween, the respective wiring materials intersect one another more densely, so that the collective bending elasticity (rigidity) of the respective wiring materials is enhanced.

In the above embodiment, the member (1) supporting the respective wiring materials is formed by cutting a pipe into a piece of ring, but it is not limited to this arrangement. For instance, this member can be made from a flat plane material through which an opening (10) is bored.

Then, with reference to FIGS. 4 to 8, a yarn unwinding tension stabilizing apparatus for a warping creel using the above stabilizers (3) is described as follows.

Figure 4:
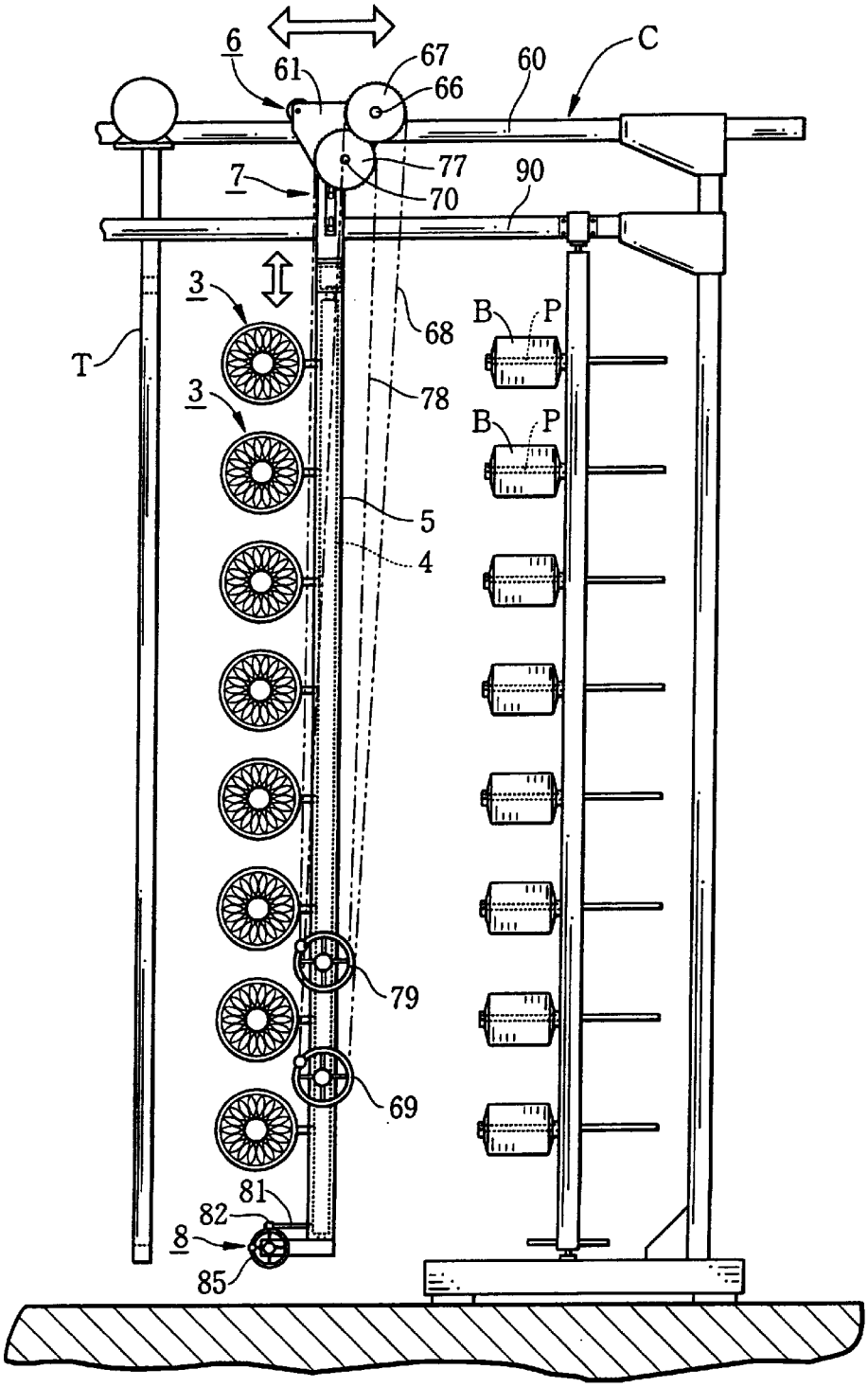
FIG. 4 is the whole side view of a yarn unwinding tension stabilizing apparatus for a warping creel using said stabilizers.

As shown in FIG. 4, the stabilizing apparatus of the present invention is, which is disposed as opposed to a multiple number of pegs (P) aligned in rows in a warping creel, is arranged so that the above stabilizers can be set on a multiple number of suppliers (B) suspended on those pegs at one time in an easy operation.

That is to say, said stabilizing apparatus comprises the plurality of tension stabilizers (3); a frame (5) supporting those stabilizers; a means (6) to horizontally move this frame so as to simultaneously make the respective stabilizers approach to and retract from the respective suppliers (B); a means (7) to vertically move said frame so as to simultaneouly adjust upper and lower positions of the respective stabilizers with regard to the respective suppliers (B); a means (8) to pivot posts (4) of said frame at one time so as to simultaneously make the respective stabilizers approach to and retract from the respective suppliers (B). Hereinafter, each of those structural elements is sequentially described in more detail. What is indicated with (T) in FIG. 4 is a conventional frame provided with a number of tensers, which are not shown in the drawing.

Figure 5:
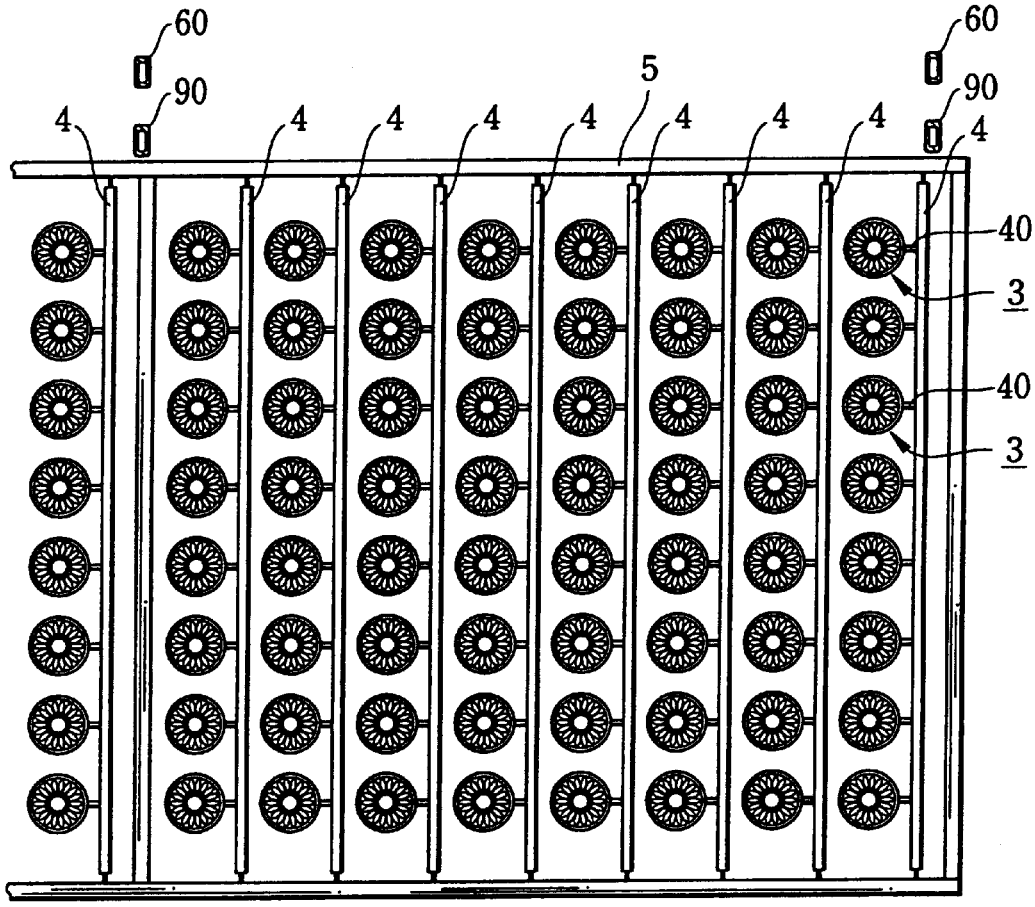
FIG. 5 is a partly frontal view of said apparatus showing its frame structure.

The frame (5) embodied in the present invention is, as shown in FIG. 5, is rectangularly enframed with square pipes, within which a plurality of vertical posts (4) are axially supported in parallel with respect to each other such that each of them is pivotable. Said stabilizers (3) are reversably supported on the respective posts (4) by way of rotatable brackets (40). The plurality of stabilizers (3) is supported on the respective posts (4) disposed in rows in alignment with the suppliers (B) suspended on the pegs (P). From FIG. 5, the means (6), (7) and (8) as described below are omitted. What is indicated with (60) and (90) in the drawing are conventionally well-known upper and lower transverse bars disposed over a warping creel to reinforce the latter.

In the present embodiment, as the stabilizers (3) are reversably supported on the respective posts (4) by means of said brackets (40), if they are reversed from time to time, it can well cope with the plastic deformation of the wiring materials (2). Also in this respect, it becomes possible to keep tension acting on the yarn stable for a long period of time.

Figure 6:
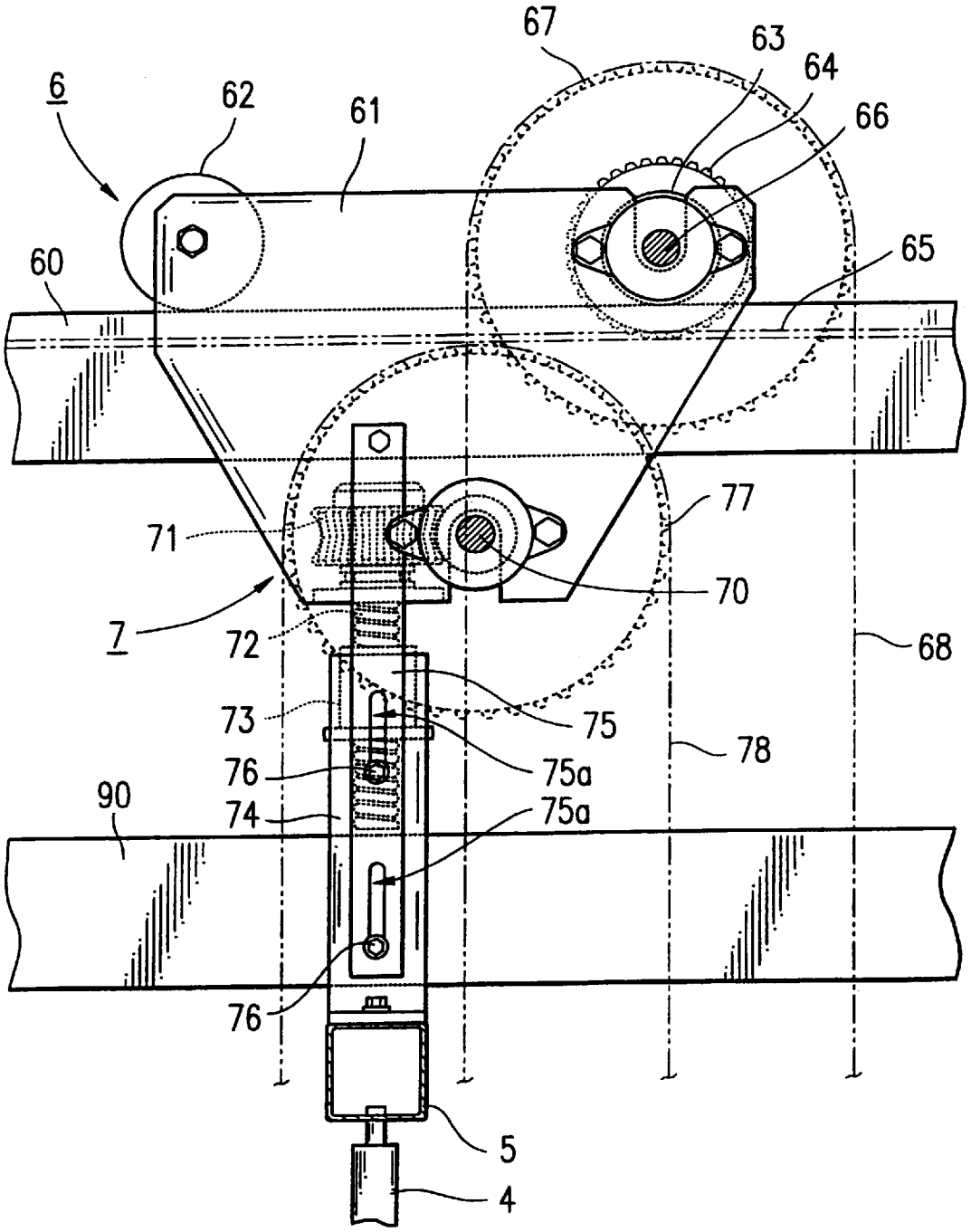
FIG. 6 is an enlarged side view of said apparatus showing its means to horizontally and vertically move said stabilizers with regard to the suppliers.
Figure 7:
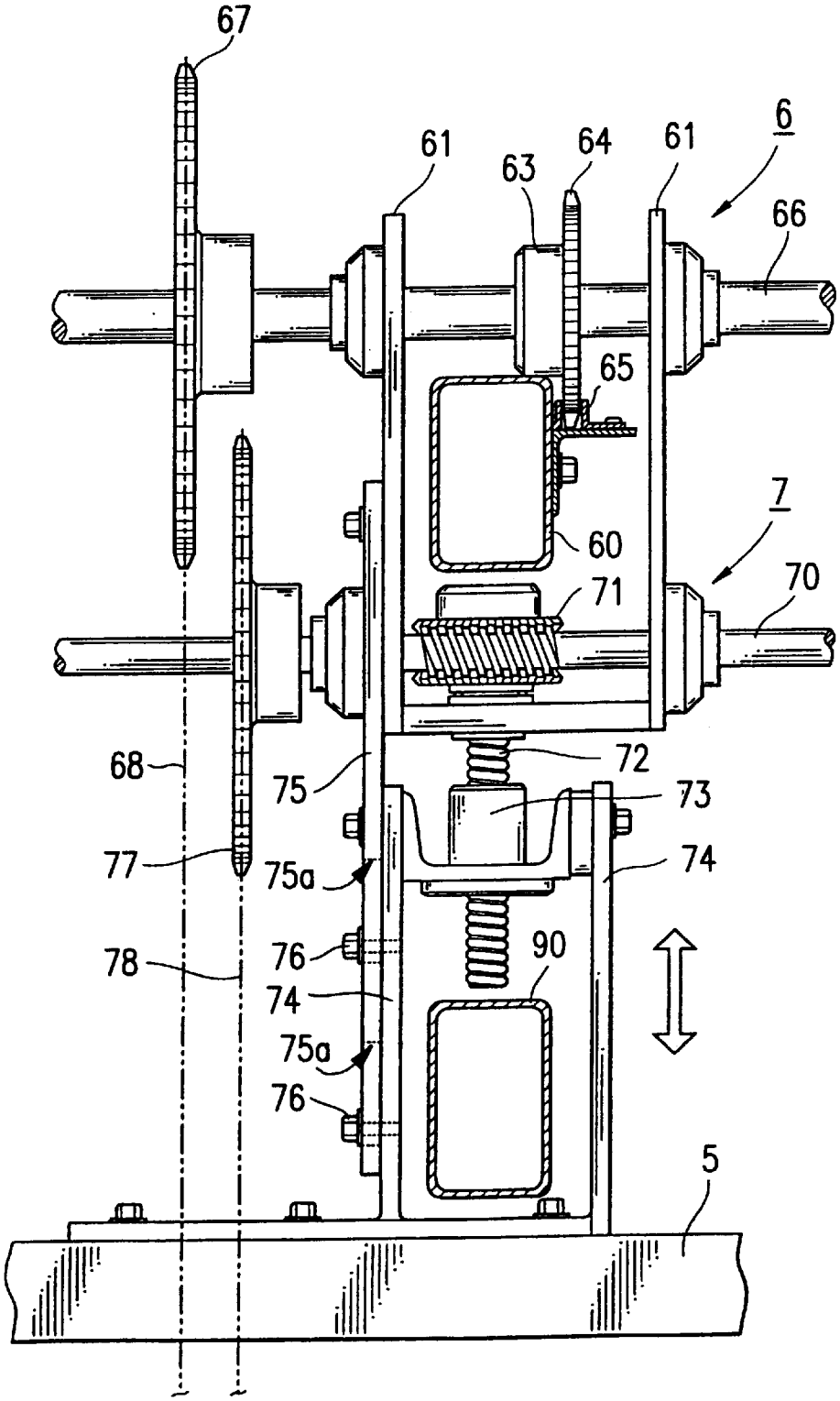
FIG. 7 is an enlarged frontal view of said apparatus showing its means to horizontally and vertically move said stabilizers.

The means (6) of the present embodiment, as shown in FIGS. 6 and 7, comprises a transverse bar (60) bridged over the creel and a trolley (61) reciprocally running on said bar (60) while suspending said frame (5) therefrom. The trolley (61) is provided with a driven wheel (62) and a drive wheel (63) rolling on the bar and reciprocally runs on said bar by interlocking a sprocket-wheel (64) driven by a shaft (66)

along with said wheel (63) with a rack (65) laid on the side of the bar. As shown in FIG. 4, the shaft (66) is driven by turning a wheel handle (69) via a sprocket-wheel (67) as well as a chain (68).

By horizontally moving the frame (5) as a whole by this means (6), the plurality of stabilizers (3) approach to and retract from the counterpart suppliers (B) at one time, or the respective stabilizers can be set (refer to FIG. 2) on the counterpart suppliers (B) at one time after the latter have been suspended on the respective pegs (P).

The means (7) of the present embodiment is, as shown in FIGS. 6 and 7, comprises a feed screw mechanism vertically disposed between the lower part of the trolley (61) and the frame (5). That is to say, a shaft (70) with a worm segment and a worm wheel (71) interdigitating with said shaft, which are disposed at right angles with respect to each other, are axially supported at the lower part of the trolley. The frame (5) as a whole vertically moves such that a screw (72) with trapezoidal threads, which is fixed at the lower part of the worm wheel (71), reciprocally moves up and down a nut (73) engaged with said screw, which is fixed above the frame through a stay (74).

What is indicated with (75) in the drawings is a guide plate to guide the frame (5) and control its up-and-down motion, which is fixed on the exterior lower side surface of the trolley (61), such that the upper and lower positions of machine screws (76) and (76) protrusively provided on said stay (74) are regulated within the longitudinal range of the apertures (75*a*) and (75*a*). In this embodiment, said worm shaft (70) rotates by means of a wheel handle (79) through a sprocket-wheel (77) and a chain (78) as shown in FIG. 4.

The use of this means (7) by which the frame (5) as a whole moves up and down makes it possible to simultaneously adjust the upper and lower positions of the plurality of stabilizers (3) with regard to the counterpart suppliers (B), so that even where the suppliers (B) of a different diameter are suspedned on pegs (P), the optimum setting adjustment of the stabilizers with regard to the suppliers can be obtained in an extremely easy operation.

Figure 8:
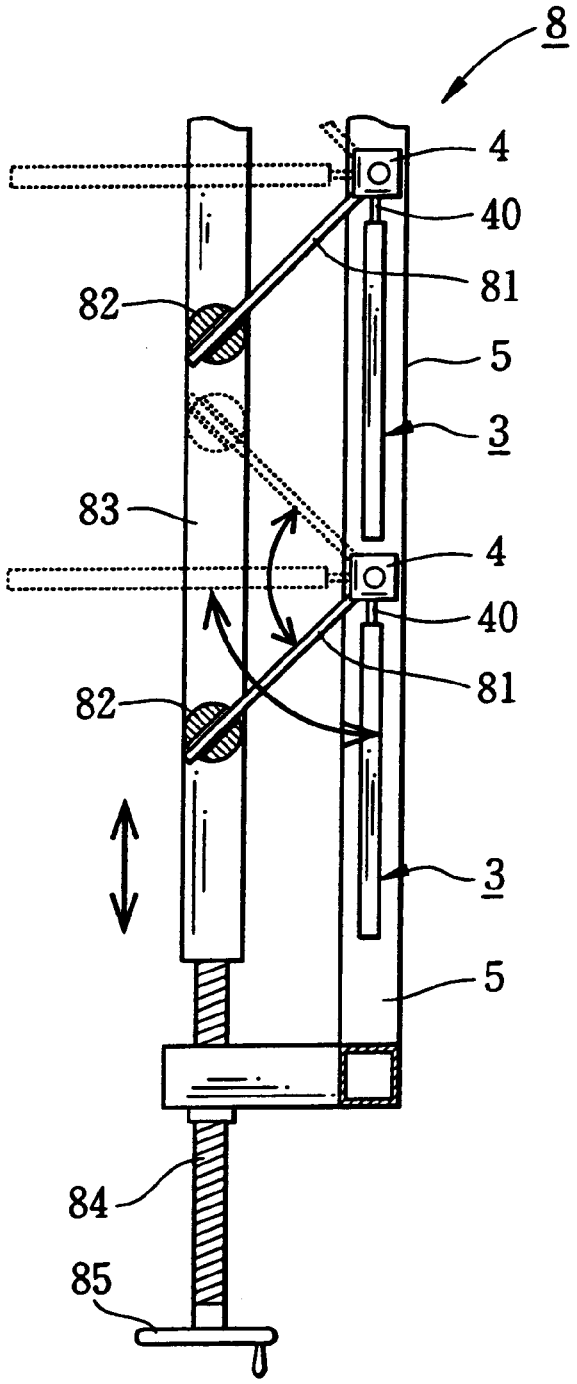
FIG. 8 is an enlarged plan view of said apparatus showing its means to rotate the posts altogether.

The means (8), as shown in FIG. 8, comprises the plurality of levers (81)•(81)•• protrusively provided from the lower part of the respective posts (4) axially supported on the frame (5), a linking bar (83) connecting those levers such that the latter are slidable and pivotable through axially supporting members (82) and a feed screw (84) reciprocally moving said bar (83). The respective posts (4) reciprocally pivot by turning a wheel handle (85) so as to reciprocally move said bar (83) through said feed screw and rotate the respective levers through said supporting members (82).

The use of this means (8) by which to pivot the respective posts (4) makes it possible to make the respective stabilizers (3) simultaneously approach to and retract from the suppliers (B), so that in the same way as the above-mentioned means (6), the respective stabilizers (3) can be set on the respective suppliers (B) at one time after the latter have been suspended on the pegs (P).

The yarn unwinding tension stabilizing apparatus embodied in the present invention is substantially constructed as mentioned above, but it is not limited to the above embodiment. It should be understood that it can be modified in various manners within the scope of the accompanying claims. For instance, in the above-mentioned embodiment, the means (6), (7) and (8) respectively is manually operated with a wheel handle, but it is not limited to this arrangement. They can be also driven by a motor.

As having been described up to here, with the yarn unwinding tension stabilizer of the present invention, as the plurality of elastic wiring materials are respectively fixed at its both ends on the supporting member, and they partly overlap one another, it becomes easier to obtain the collective bending elasticity of the respective wiring materials that is optimum for tension stabilization as well as the respective wiring materials are hardly subjected to permanent set, with the result that it becomes possible to keep tension acting on the yarn stable for a long period of time.

As an unwinding area is formed such that it is enclosed with the respective wiring materials that concavely curve towards the center of the opening of the supporting member with their both ends fixed on the periphery thereof, a yarn unwound from the supplier while rotating along the yarn surface thereof and the respective wiring materials contact each other in a smooth and stable manner so that there is no case where the latter are twisted at the unwinding operation, with the result that such operation can be performed in an extremely stable and secure manner.

Moreover, as the tension stabilizer embodied in the present invention takes advantage of the collective bending elasticity of the plurality of wiring materials that overlap one another, the change in diameter of a yarn layer wound on the supplier does not affect tension stabilization so that it can secure optimum tension on the yarn throughout the operation.

Furthermore, as the tension stabilizing apparatus embodied in the present invention is arranged such that it can make the whole frame supporting a multiple number of tension stabilizers approach to and retract from the suppliers suspended on the pegs, said stabilizers can be set on those suppliers at one time in an easy operation, so that it dispenses with such a burdensome preparation as in the prior art where a cylindrical sheet is covered with the respective suppliers.

As mentioned above, a yarn unwinding tension stabilizer as well as a yarn unwinding tension stabilizing apparatus for a warping creel using said stabilizers embodied in the present invention are useful to stabiliize tension acting on a yarn when said yarn is unwound from various types of suppliers in such shapes as cheese and cone, and the setting of said stabilizers on a multiple number of suppliers suspended on a warping creel can be performed in an easy operation, so that its industrial applicability is very high.

What is claimed is:

1. A yarn unwinding tension stabilizing apparatus for a warping creel, which is disposed opposed to a plurality of pegs (P) aligned in rows in the creel and which stabilizes tension acting on a yarn (Y) unwound from the respective yarn suppliers (B) suspended on said pegs (P), said stabilizing apparatus comprising:

a plurality of tension stabilizers (3) respectively made of a supporting member (1) provided with an opening (10) of a diameter and a plurality of elastic wiring materials (2) disposed within said opening (10) wherein the respective wiring materials (2) are fixed at both ends thereof on the periphery of said opening (10) while partly overlapping one another and an unwinding area (20) is formed at a center, which is enclosed with those overlapped wiring materials (2);

a frame (5) supporting those tension stabilizers (3) in alignment with yarn suppliers (B) suspended on said pegs (P); and a means (6) to horizontally move said frame (5) so as to make said tension stabilizers (3) simultaneously approach to or retract from said yarn suppliers (B).

2. A yarn unwinding tension stabilizing apparatus for a warping creel according to claim 1, wherein the respective tension stabilizers (3) are pivotally supported on the frame (5) by means of a bracket (40).

3. A yarn unwinding tension stabilizing apparatus for a warping creel according to claim 1, wherein said means (6) to horizontally move said frame comprises a transverse bar (60) bridged over the creel and a trolley (61) arranged so that it can reciprocally run on said bar (60), the frame (5) being suspended below said trolley (61).

4. A yarn unwinding tension stabilizing apparatus for a warping creel according to claim 3, wherein the respective tension stabilizers (3) are pivotally supported on the frame (5) by means of a bracket (40).

5. A yarn unwinding tension stabilizing apparatus for a warping creel, which is disposed as opposed to a plurality of pegs (P) aligned in rows in a warping creel and stabilizes tension acting on a yarn (Y) unwound from the respective yarn suppliers (B) suspended on said pegs (P), said stabilizing apparatus comprising:

a plurality of tension stabilizers (3) each made of a supporting member (1) provided with an opening (10) of a diameter and a plurality of elastic wiring materials (2) disposed within said opening (10) wherein the respective wiring materials (2) are fixed at both ends thereof on the periphery of said opening (10) and convexly curve towards a center of said opening (10) while partly overlapping one another and an unwinding area (20) is formed at said center, which is enclosed with those overlapped wiring materials (2);

a frame (5) supporting those tension stabilizers (3) in alignment with the suppliers (B) suspended on said pegs (P); a means (6) to horizontally move said frame (5) so as to make said tension stabilizers (3) simultaneously approach to or retract from said suppliers (B); and a means (7) to vertically move said frame (5) so as to simultaneously adjust an upper or lower position of the plurality of said tension stabilizers (3).

6. A yarn unwinding tension stabilizing apparatus for a warping creel according to claim 5, wherein the respective tension stabilizers (3) are pivotally supported on the frame (5) by means of a bracket (40).

7. A yarn unwinding tension stabilizing apparatus for a warping creel according to claim 5, wherein said means (6) to horizontally move said frame comprises a transverse bar (60) bridged over the creel and a trolley (61) arranged so that it can reciprocally run on said bar (60), the frame (5) being suspended below said trolley (61).

8. A yarn unwinding tension stabilizing apparatus for a warping creel according to claim 7, wherein the respective tension stabilizers (3) are reversibly supported on the frame (5) by means of a bracket (40).

9. A yarn unwinding tension stabilizing apparatus for a warping creel according to claim 5, wherein said means (7) to vertically move said frame (5) adopts a feed screw mechanism vertically disposed on a trolley (61) capable of reciprocally running on a transverse bar (60) bridged over the warping creel.

10. A yarn unwinding tension stabilizing apparatus for a warping creel according to claim 9, wherein the respective tension stabilizers (3) are reversibly supported on the frame (5) by means of a bracket (40).

11. A yarn unwinding tension stabilizing apparatus for a warping creel, which is disposed opposed to a plurality of pegs (P) aligned in rows in the creel and stabilizes tension acting on a yarn (Y) unwound from the respective yarn suppliers (B) suspended on said pegs (P), said stabilizing apparatus comprising:

plurality of tension stabilizers (3) respectively made of a supporting member (1) provided with an opening (10) of a diameter and a plurality of elastic wiring materials (2) disposed within said opening (10) wherein the respective wiring materials (2) are fixed at both ends thereof on the periphery of said opening (10) and convexly curve towards a center of said opening (10) while partly overlapping one another and an unwinding area (20) is formed at said center, which is enclosed with those overlapped wiring materials (2);

a plurality of posts (4) each supporting one row of said tension stabilizers (3) in alignment with the suppliers (B) suspended on the pegs (P);

a frame (5) axially supporting said posts (4) so that each of them pivots;

a means (6) to horizontally move said frame (5) so as to make said tension stabilizers (3) simultaneously approach to or retract from said suppliers (B);

a means (7) to vertically move said frame (5) so as to simultaneously adjust an upper or lower position of the plurality of said tension stabilizers (3); and a means (8) to rotate said posts (4) altogether so as to make said tension stabilizers (3) simultaneously approach to or retract from said suppliers (B).

12. A yarn unwinding tension stabilizing apparatus for a warping creel according to claim 11, wherein the respective tension stabilizers (3) are reversibly supported on the frame (5) by means of a bracket (40).

13. A yarn unwinding tension stabilizing apparatus for a warping creel according to claim 11, wherein said means (6) to horizontally move said frame comprises a transverse bar (60) bridged over the creel and a trolley (61) arranged so that it can reciprocally run on said bar (60),
the frame (5) being suspended below said trolley (61).

14. A yarn unwinding tension stabilizing apparatus for a warping creel according to claim 13, wherein the respective tension stabilizers (3) are reversibly supported on the frame (5) by means of a bracket (40).

15. A yarn unwinding tension stabilizing apparatus for a warping creel according to claim 11, wherein said means (7) to vertically move said frame (5) adopts a feed screw mechanism vertically disposed on a trolley (61) capable of reciprocally running on a transverse bar (60) bridged over the warping creel.

16. A yarn unwinding tension stabilizing apparatus for a warping creel according to claim 15, wherein the respective tension stabilizers (3) are reversibly supported on the frame (5) by means of a bracket (40).

17. A yarn unwinding tension stabilizing apparatus for a warping creel according to claim 11, wherein said means (8) includes a plurality of levers (81) each protrusively provided on the respective posts (4) and aligned parallelwise with regard to one another, and a linking bar (83) to axially engage with said levers (81).

18. A yarn unwinding tension stabilizing apparatus for a warping creel according to claim 17, wherein the respective tension stabilizers (3) are reversibly supported on the frame (5) by means of a bracket (40).

* * * * *